United States Patent [19]

Montgomery et al.

[11] 4,335,823

[45] Jun. 22, 1982

[54] CHILD-RESISTANT PACKAGE

[75] Inventors: Gary V. Montgomery; Randall G. Bush, both of Evansville, Ind.

[73] Assignee: Sunbeam Plastics Corporation, Evansville, Ind.

[21] Appl. No.: 228,286

[22] Filed: Jan. 26, 1981

[51] Int. Cl.[3] ..... A61J 1/00; B65D 55/02

[52] U.S. Cl. ..... 215/206; 215/216; 215/224; 215/318

[58] Field of Search ..... 215/206, 211, 212, 214, 215/216, 224, 318

[56] References Cited

U.S. PATENT DOCUMENTS

| | | | |
|---|---|---|---|
| 3,923,181 | 12/1975 | Libit | 215/224 |
| 3,955,696 | 5/1976 | Finke | 215/224 |
| 4,298,129 | 11/1981 | Stull | 215/224 |

*Primary Examiner*—George T. Hall

*Attorney, Agent, or Firm*—Fisher, Gerhardt, Crampton & Groh

[57] ABSTRACT

A child-resistant package consists of a container having an open-ended neck and a cap having a top and an annular skirt which telescopes over the container neck. There are co-operating snap-over retainers on the exterior of the neck and the interior of the cap skirt which require the cap to be moved axially a distance greater than the axial over-lap of the retainers in order to remove the cap. The container neck and the cap skirt also have a radially extending lug and a circumferentially extending ramp that are moved into engageable alignment by flexing the cap skirt inwardly. The ramp has a surface which is inclined relative to the axis of the neck and cap skirt and which has an axial height greater than the distance of axial over-lap of the retainers. In order to remove the cap, the skirt is flexed inwardly to align the lug with the ramp surface and the cap is rotated relative to the container neck causing the cap to be moved axially a distance sufficient to disengage the over-lapped retainers. A stop bar is formed near the beginning end of the ramp which is spaced circumferentially from the ramp a distance only slightly greater than the circumferential width of the lug so that the lug must be inserted into such space when the skirt is flexed inwardly in order to engage the lug with the ramp when the cap is rotated relative to the container for removing the cap.

11 Claims, 10 Drawing Figures

CHILD-RESISTANT PACKAGE

This invention relates to container closures and more particularly to child-resistant or child-proof container and enclosure combinations.

Although many dozens of child-resistant or so-called "child-proof" container closures or combinations of containers and closures have been suggested and many patents have issued on those devices, relatively few have been successful in the market place.

Some of the devices have been much too complicated so that the cost to manufacture them has been prohibitive. Others have failed the tests under the protocol of the Poison Prevention Packaging Act of 1970 because it has been possible for a small child to gain access to the contents of a container having a supposedly child-resistant closure where the closure was of such size and operated in such fashion that the child could bite the closure and hold the container in its hands to either pry off the closure or turn it to unscrew it from the neck of the container.

While some successful child-resistant closures have consisted of two separately molded parts such as a screw cap and an overcap which must be properly manipulated in order to provide for unscrewing the screw cap, these two-part closures are more expensive than single piece closures because two separate molds are required for their production and the two parts must be assembled to each other before they can be delivered to the location where the containers are filled and the caps are placed on the containers.

In the experience resulting from the design and testing of closures and combinations of closures and containers intended to be child-resistant it has been found that the most effective arrangements are those in which two distinctively different movements must be made in order to open the package, i.e., to remove the closure.

It is, therefore, the principal object of the instant invention to provide a child-resistant package for pharmaceuticals, household chemicals and other potentially harmful substances consisting of a container having an open-ended neck and a one-piece closure having means which cooperate with the elements of the neck to make the package child-resistant.

It is yet another object of the instant invention to provide a child-resistant package comprising a closure of the type generally referred to as "squeeze and turn" in which the container neck and the closure have co-operating rib means for retaining the closure on the container neck and which also have co-operating means that are engageable by deforming the skirt of the cup-shaped closure radially inwardly to bring these latter means into circumferential alignment so that subsequent rotation of the closure relative to the container neck will result in disengaging the rib means and removal of the closure.

Yet another important aspect of the instant invention resides in the fact that the co-operating means on the container neck and on the skirt of the closure cannot be circumferentially aligned with each other so as to result in the closure being forced upwardly by its subsequent rotation except when certain indicia on the container and the closure are aligned with each other, this alignment being perceptible to an older child or an adult.

The objects of the invention are accomplished by a child-resistant package wherein a container has a body and a tubular open-ended neck joined to the body, a cup-shaped closure for the neck having an annular skirt adapted to be telescoped over the neck, retainer means on the neck and the skirt for retaining the closure in closed position on the neck during relative rotation of the closure and the container, the retainer means being disengagable by axial movement of the closure relative to the neck. A pair of elements are formed on the outer surface of the neck and the inner surface of the skirt, respectively, with the elements having a radial thickness such that they do not engage each other when the closure is rotated on the neck with the skirt in its normal annular configuration. A first of the elements has a ramp surface extending angularly and circumferentially an axial distance greater than the distance of axial movement required to disengage the retainer means and a second of the elements is positioned at an axial level for engagement with the ramp surface of the first of the elements when the skirt is flexed radially inwardly and the closure is rotated to cause the closure to move axially to disengage the retainer means. A guard element is formed on the same surface as the first of the elements and is spaced therefrom a circumferential distance only enough to provide a keyway for the radial insertion of the second of the elements when the skirt is flexed radially inwardly. Unless exact alignment is first achieved, the subsequent squeezing and rotations of the cap is ineffective to open the container.

These and other objects of the invention will become apparent from the description and from the following drawings disclosing preferred embodiments of the invention:

Figure 4:
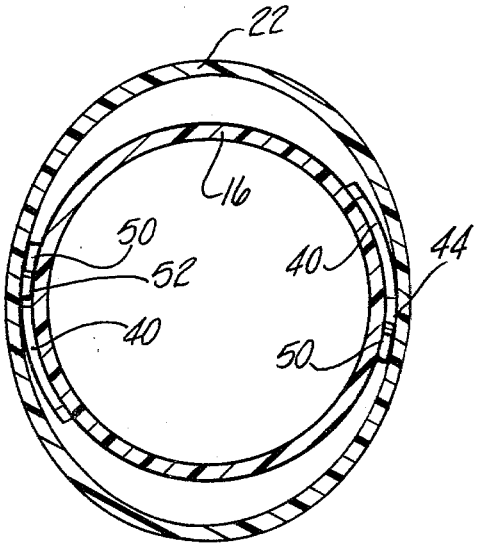
FIG. 4 is a horizontal sectional view taken along line 4—4 of FIG. 3 and showing how the closure is deformed in order to bring co-operating means into alignment so as to enable the removal of the closure from the container neck.
Figure 5:
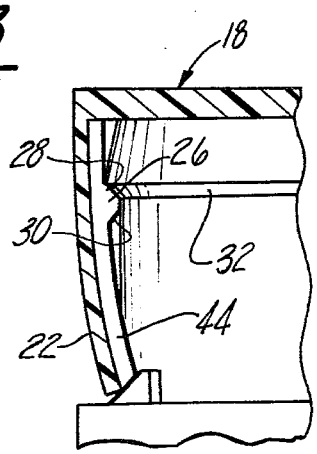
FIG. 5 is a fragmentary vertical sectional view similar to the left part of FIG. 3 and showing how the skirt of the closure is deformed inwardly to align the means by which removal of the closure may be effected.
Figure 6:
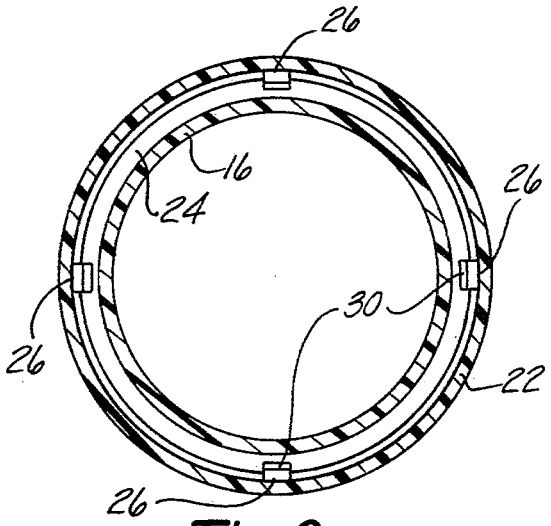
FIG. 6 is a cross-sectional view taken on line 6—6 in FIG. 3.

The invention is embodied in a package, a portion of which is indicated at 10 in FIGS. 1 through 5. The package 10 includes a container 12 and a closure 14. The container 12 has a tubular open-ended neck 16 and an inverted cup-shaped closure or cap 18 that is adapted to telescope over and close the open end of the container neck 16. The closure or cap 18 preferably is made of a plastic material and has a disc-like top 20 and a cylindrical stiffly flexible skirt 22. The container neck 16 has a continuous annular bead 24 which cooperates with a plurality of uniformly spaced tab elements 26 on the inner wall of the skirt 22. As shown in FIG. 6 at least four uniformly spaced tab elements are preferred. The tab elements 26 extend radially inwardly and have inclined upper and lower cam surfaces 28 and 30, respectively, which are adapted to engage the bead 24 during closing and opening of the package 10. The outer diameter of the apex of the bead 24 and the radial inner edges of the tab elements 26 are selected of a dimension to interfere with each other. When the closure 14 is placed on the neck 16, the lower cam surfaces 30 engage the bead 24 to distort the skirt 22 sufficiently so that the closure 14 can move axially relative to the neck 16 until the upper cam surfaces 28 engage the annular surface 32 at the underside of the bead 28. When the cap is removed the upper cam surface coacts with the bead 24 to distort the skirt 22 sufficiently so that the closure 14 can be moved axially relative to the container 12 for removal or opening of the package 10.

Figure 3:
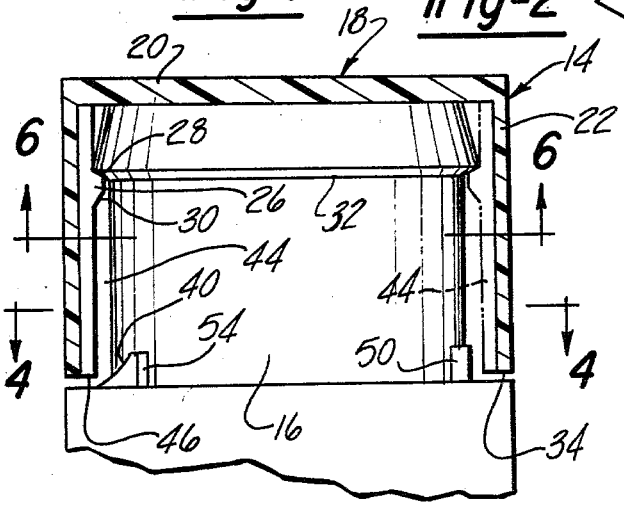
FIG. 3 is a vertical sectional view of a closure taken along a diameter thereof illustrating how the closure is retained on the neck of a container with the closure in its normal closed position.

When the closure 14 is in its closed position as illustrated in FIG. 3 it is extremely difficult to pull the closure 14 from the neck 16. Also, the bead 24 and the cooperating tab elements 26 permit the closure 14 to be rotated relative to the neck 16 but still retain the closure in position to close the open end of the neck 16. In addition, the lower lip 34 of the skirt 22 extends downwardly into closed adjacent relationship to a shoulder 36 formed between the neck 16 and the remainder of the body of the container 12. Preferably the lip 34 is spaced sufficiently to permit rotation of the closure 14 relative to the neck 16 but at the same time prevents the insertion of a tool by which the closure 14 might be pried up to disengage the tab elements 26 from the bead 24.

Figure 2:
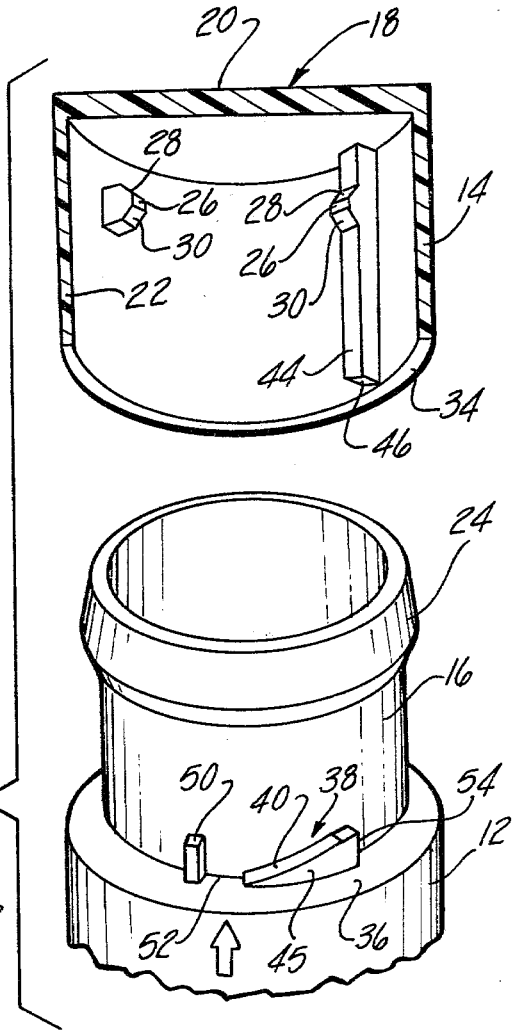
FIG. 2 is a fragmentary, exploded view with the closure shown in section of a package according to the invention, the container neck and closure being particularly shown.

Removal of the closure 14 from the neck 16 requires relative axial displacement and the amount of such axial displacement is determined by the axial length of the tab elements 26 and more particularly to the axial length of the upper cam surface 28 and the distance between the upper and lower cam surfaces 28 and 30. The means for effecting the axial displacement of the closure 14 that is required to open the container 12 includes a circumferentially extending ramp element 38 located on the outer surface of the container neck 16 and against the shoulder 36. Preferably a pair of such ramp elements 38 is employed and are disposed at diametrically opposite sides of the container neck 16. The ramp elements 38 each have a ramp or guide surface 40 which extends from the shoulder 36 an axial distance slightly greater than the distance that the closure 18 must be moved axially to disengage the tab elements 26 from the bead 24. The interior surface of the closure 14 is provided with a pair of radially inwardly extending lugs or ribs 44 with bottom end portions 46 adapted to engage the guide or ramp surface 40 during rotation of the closure 14 relative to the neck 16. The lugs 44 can extend the full axial length of the interior of the closure 14 as seen in FIG. 2 and each incorporate one of the tab elements 26. Preferably there are two such ribs 44 on the inner surface of the skirt 22 of the closure 14 which are diametrically opposed to each other.

The ramp elements 38 having an outer circumferential surface 45 with a radius slightly less than the spacing between the diametrically opposed ribs 44 so that the closure 14 is freely rotatable on the container 16. As a result, mere rotation of the closure 14 is not effective to bring about removal of the closure 14 from the neck 16.

In order to remove the closure 14 from the neck 16 two motions are required. It is necessary first to squeeze the flexible skirt 22 of the closure 14 at diametrically opposed points opposite the ribs 44. This flexes the skirt 22 and the ribs 44 inwardly toward each other as best seen in FIGS. 4 and 5 so that the lower ends 46 of the ribs 44 engage and are moved into circumferential alignment with the guide surfaces 40 on the ramp elements 38. Subsequent rotation of the closure 14 through a few degrees while the skirt 22 is maintained in its deflected position serves to force the ribs 44 up the full length of the relatively short ramp 40 and force the closure 14 axially a sufficient distance to disengage the tab elements 26 from the bead 24.

Although the requirement for inward flexure of the skirt 22 and subsequent rotation of the closure 14 renders the package reasonably child-resistant, the present embodiment of the invention has additional safety features. As best seen in FIG. 2, a guard or stop 50 is located on the exterior of the neck 16 and in circumferentially spaced relationship the lower end or beginning portion of the ramp surface 40 of the ramp elements 38. The stops 50 are spaced away from the lower edge of the guide surfaces 40 a distance only slightly greater than the circumferential extent of the ramp engaging ribs 44. Consequently, the spacing between the stop 50 and the beginning of the guide surface 40 forms a space or keyway 52 into which the ribs 44 must be deflected to bring about the necessary alignment so that subsequent rotation of the closure 14 can move it axially relative to the neck. In the event that the ribs 44 are not aligned with the keyways 52, deflection of the skirt 22 and subsequent rotation of the closure 14 will result in the ribs 44 coming into engagement with either the stop 50 or an end 54 of the ramp element 38 opposite to the ramp 40. In the absence of deflection of the skirt 22, the closure 14 is permitted to rotate because of the clearance provided between the ribs 44 on the closure 14 and the outer circumferential surfaces of the stop 50 and ramp element 38.

Figure 1:
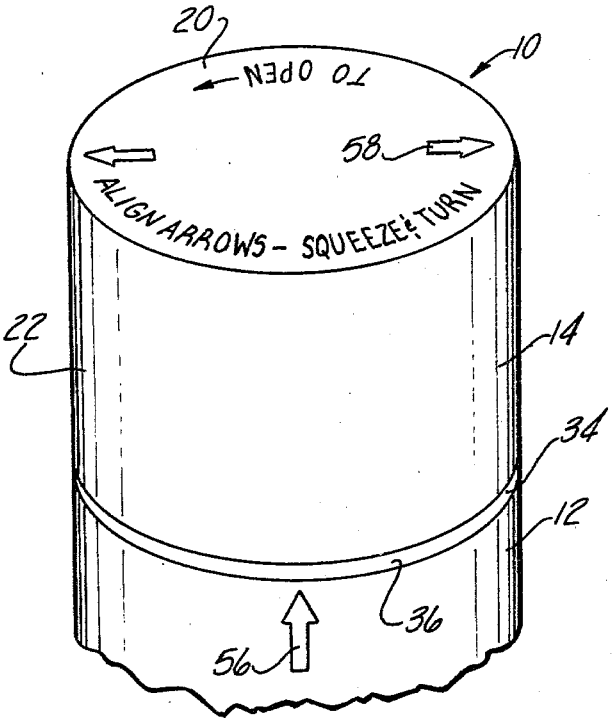
FIG. 1 is a fragmentary view in perspective of a package embodying the invention showing a portion of the container and a closure in closed position thereon.

Instructions relative to removal of the closure 14 from the neck 16 can be in the form of a legend appearing on the closure top 18 as illustrated in FIG. 1.

To facilitate alignment of the closure 14 with the container 12, arrow 56 on the container 12 and 58 on the closure 16 are provided which when aligned vertically, insure that the ramp engaging ribs 44 will be positioned radially opposite the keyways 52. Subsequent flexing of the skirt 22 will bring the ribs 44 into circumferential alignment with the guide or ramp surfaces 40 so that subsequent rotation of the closure 14 will cause the ribs 44 to ride up the ramp surfaces 40 to cause axial movement of the closure 14 relative to the neck 16 and disengagement of the bead 24 and the top elements 26.

If a younger child endeavors to squeeze the closure skirt 22 radially inwardly, for example, even by biting it and then rotating the closure relative to the container, the odds are that the ramp engaging ribs 44 will engage the stops 50 or the stop surface 54 of the ramp elements 38. It is only upon precise alignment of the indicia 56 and 58 by one capable of reading the instructions on the top of the closure 14 that proper alignment for engagement of the ribs 44 with the ramp elements 38 can be achieved.

Figure 7:
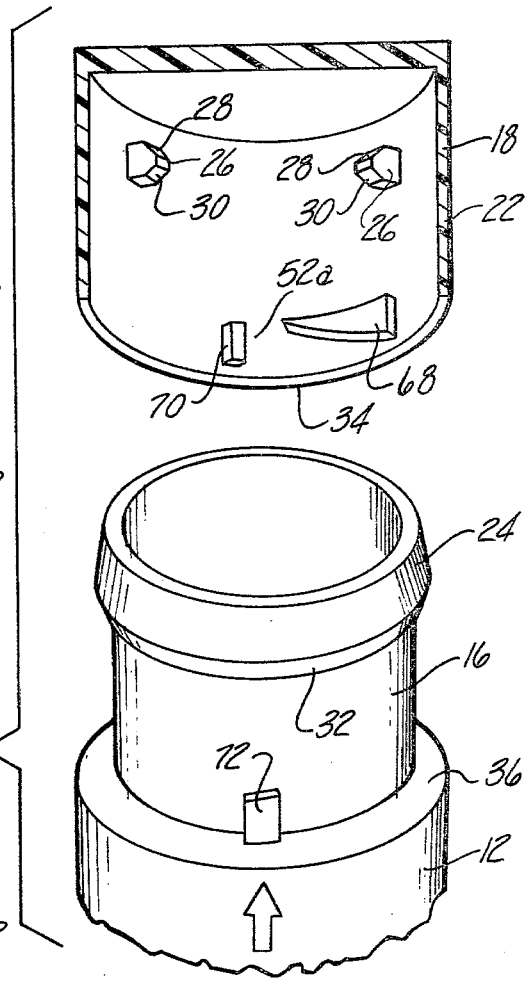
FIGS. 7 through 10 illustrate another embodiment of a package embodying the invention, each of the Figures corresponding, respectively, to FIGS. 2 through 5.
Figure 8:
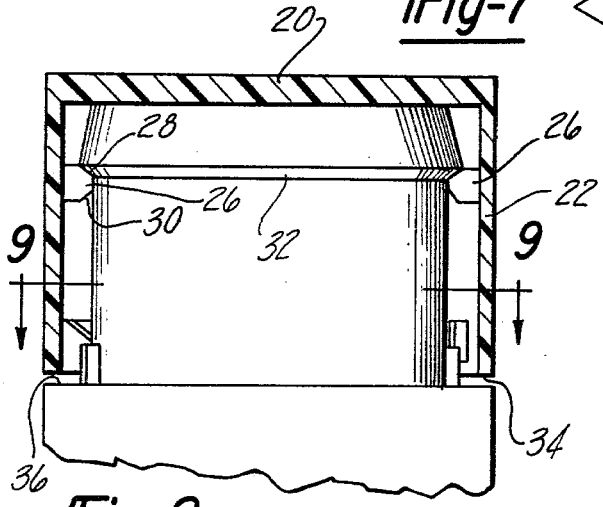
Figure 9:
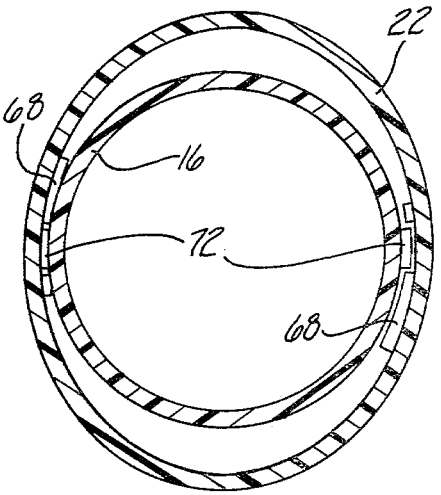
Figure 10:
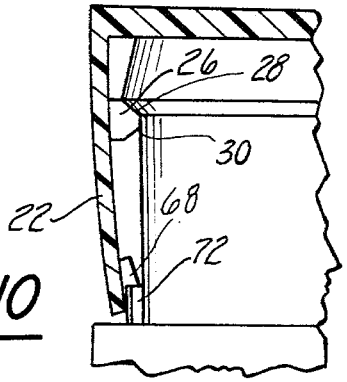

Another embodiment of the invention is illustrated in FIGS. 7 through 10 which correspond to FIGS. 2 through 5 illustrating the first embodiment of the invention. In FIGS. 7 through 9, like parts have been identified with the same reference characters. The principal differences are that a pair of ramp elements 68 and a pair of guard elements 70 corresponding substantially to the ramp elements 38 and guard elements 50, respectively, of the first embodiment of the invention are formed on the interior surface of the closure 18 instead of on the outer surface of the neck 16. Also, the lugs or ribs 44 are replaced by short lug or rib elements 72 disposed on the shoulder 76 formed at the juncture of the neck of the container 12. In all other respects, the second embodiment of the invention is the same in construction as the first embodiment. Also, operation is substantially identical in that opening of the package 10 first requires alignment of the indicia arrows 56 and 58 followed by the subsequent radial inward squeezing of the skirt 22 of the closure 14 to move the ramp elements 68 radially inwardly so that rib elements 72 are received in the keyway 52*a*. Subsequent rotation of the closure 14 in a counter-clockwise direction brings the rib elements 72 into engagement with the ramp elements 68 and forces the closure 14 axially of the neck 16 to release tabs 26 from the bead 24 for removal of the closure.

A childproof closure and container combination has been provided in which at least two distinctive motions are required to afford removal of the closure from the container. These motions are the squeezing and flexing of the closure skirt followed by rotation of the closure. However, even before these two motions occur, it first is necessary to properly align the closure and the container visually pursuant to instructions presented by a legend on the package.

The embodiments of the invention in which an exclusive property or privilege is claimed are defined as follows:

1. A child-resistant package comprising: a container having a body and a tubular open-ended neck joined to said body, a cup-shaped closure for said neck having an annular skirt adapted to telescope over said neck, retainer means on said neck and said skirt for retaining said closure in closed position on said neck during relative rotation of said closure and said container, said retainer means being disengageable by axial movement of said closure relative to said neck, a pair of elements on the outer surface of said neck and the inner surface of said skirt, respectively, said elements having a radial thickness such that they do not engage when said closure is rotated on said neck with said skirt in its normal annular configuration, a first of said elements having a ramp surface extending angularly and circumferentially an axial distance greater than the distance of axial movement required to disengage said retainer means, a second of said elements being positioned at an axial level for engagement with said ramp surface of said first of said elements when said skirt is flexed radially inwardly and said closure is rotated to cause said closure to move axially to disengage said retainer means, and a guard element formed on the same surface as said first of said elements and spaced therefrom a circumferential distance only enough to provide a keyway for the radial insertion of the second of said elements therein.

2. The child-resistant package according to claim 1 wherein a second pair of elements are diametrically spaced from said first mentioned pair of elements on the outer surface of said neck and on the inner surface of said skirt, respectively.

3. The child-resistant package of claim 1 wherein said guard element and said one element on the same surface provide stop surfaces spaced circumferentially of each other and at opposite sides of said keyway to engage said second of said elements upon radial inward deflection of the latter with said skirt in a location not aligned with said keyway to prevent axial displacement of said cap upon rotation of the latter.

4. A child-resistant package according to claim 1 wherein an annular shoulder is formed on said container at the juncture of said neck and said body, said skirt extending into close axial proximity with said shoulder when said cap is in a closed position.

5. A child-resistant package according to claim 4 wherein one of said elements of said pair of elements is located at said juncture of said neck and said body.

6. A child-resistant package according to claim 5 wherein said one of said elements is said first of said elements having a cam surface.

7. A child-resistant package of claim 1 wherein said retainer means includes an annular bead on the outer surface of said neck and cooperating bead means on an inner surface of said closure.

8. The child-resistant package of claim 7 wherein said annular bead is continuous and wherein said bead means on said cap is segmented.

9. A child-resistant package according to claim 7 wherein said bead means on the container neck and the said skirt have, respectively, radially outwardly and radially inwardly angular apices of overlapping diameters.

10. A child-resistant package as set forth in claim 1 including indicia on said body and said cap to indicate alignment of said keyway and said other element.

11. A child-resistant package comprising:

a container having a body and an open-ended tubular neck joined to said body to form a shoulder, a cup shaped closure for said neck having a stiffly resilient annular skirt adapted to telescope over said neck, bead means on the outer side of said container neck and on the internal side of said skirt, said bead means being overlapped when said closure is in closed position for retaining said closure on said neck, a ramp element formed as a unit with said container shoulder and the outer side of said neck and extending angularly from said shoulder towards the open end of said neck, a ramp-engaging lug element on the inner side of said closure skirt having the innermost portion of said lug lying radially outwardly of a radial outer side of said ramp, said closure skirt being radially inwardly deformable for moving said lug radially inwardly into circumferential alignment for engaging said ramp when said closure is rotated relative to said container, to engage said ramp for moving said cap axially relative to said neck and disengaging said bead means for separating said closure and said neck, and a guard element spaced circumferentially to one side of said ramp element a distance slightly more than the circumferential dimension of said ramp engaging lug to form a keyway, said ramp element and guard element limiting rotation of said cap in opposite directions from said keyway and preventing engagement of said lug with said ramp element except when said lug element and keyway are in alignment with each other, and indicia on said cap and said body member to indicate alignment of said lug with said keyway.

* * * * *